US007377995B2

(12) United States Patent
Chen et al.

(10) Patent No.: US 7,377,995 B2
(45) Date of Patent: May 27, 2008

(54) SOFT DURABLE TISSUE

(75) Inventors: Patrick Pachih Chen, Appleton, WI (US); Michael Alan Hermans, Neenah, WI (US); Pau-Lin Pawar, Appleton, WI (US); Thomas Gerard Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 692 days.

(21) Appl. No.: 10/845,278

(22) Filed: May 12, 2004

(65) Prior Publication Data

US 2005/0252626 A1 Nov. 17, 2005

(51) Int. Cl.
*D21H 27/30* (2006.01)
*D21H 27/38* (2006.01)

(52) U.S. Cl. ..... 162/124; 162/127; 162/128; 162/109; 162/179; 428/172

(58) Field of Classification Search ..... 162/109, 162/111–113, 123–133, 158, 135, 168.1, 162/169, 179; 428/152–153, 156, 537.5, 428/172; 264/282–283; 424/402
See application file for complete search history.

(56) References Cited

U.S. PATENT DOCUMENTS

| | | | | |
|---|---|---|---|---|
| 3,903,342 | A * | 9/1975 | Robets, Jr. | 428/153 |
| 4,100,017 | A | 7/1978 | Flautt | |
| 4,166,001 | A | 8/1979 | Dunning et al. | |
| 4,482,429 | A | 11/1984 | Klowak | |
| 4,507,351 | A | 3/1985 | Johnson et al. | |
| 4,959,125 | A | 9/1990 | Spendel | |
| 5,200,037 | A | 4/1993 | Noda | |
| 5,277,761 | A | 1/1994 | Van Phan et al. | |
| 5,366,785 | A | 11/1994 | Sawdai | |
| 5,405,501 | A * | 4/1995 | Phan et al. | 162/127 |
| 5,443,691 | A | 8/1995 | Phan et al. | |
| 5,556,509 | A | 9/1996 | Trokhan et al. | |
| 5,573,637 | A * | 11/1996 | Ampulski et al. | 162/112 |
| 5,593,545 | A | 1/1997 | Rugowski et al. | |
| 5,607,551 | A | 3/1997 | Farrington et al. | |
| 5,637,194 | A | 6/1997 | Ampulski et al. | |
| 5,667,635 | A | 9/1997 | Win et al. | |
| 5,672,248 | A | 9/1997 | Wendt et al. | |
| 5,714,041 | A | 2/1998 | Ayers et al. | |
| 5,885,418 | A * | 3/1999 | Anderson et al. | 162/112 |
| 5,981,044 | A * | 11/1999 | Phan et al. | 428/212 |
| 6,129,815 | A * | 10/2000 | Larson et al. | 162/112 |
| 6,248,212 | B1 * | 6/2001 | Anderson et al. | 162/112 |
| 6,328,850 | B1 * | 12/2001 | Phan et al. | 162/123 |
| 6,368,454 | B1 | 4/2002 | Dwiggins et al. | |
| 6,464,829 | B1 | 10/2002 | Chen et al. | |
| 6,478,927 | B1 | 11/2002 | Chen et al. | |
| 6,500,289 | B2 * | 12/2002 | Merker et al. | 156/183 |
| 6,673,203 | B1 * | 1/2004 | Neal et al. | 162/112 |
| 6,846,383 | B2 * | 1/2005 | Tirimacco | 162/112 |
| 6,861,380 | B2 * | 3/2005 | Garnier et al. | 442/413 |
| 6,918,993 | B2 * | 7/2005 | Tirimacco | 162/111 |
| 7,056,572 | B1 * | 6/2006 | Smith et al. | 428/211.1 |
| 2003/0056917 | A1 * | 3/2003 | Jimenez | 162/158 |
| 2003/0127203 | A1 * | 7/2003 | Hu | 162/130 |
| 2004/0007339 | A1 | 1/2004 | Tirimacco | |
| 2004/0112558 | A1 * | 6/2004 | Garnier et al. | 162/129 |
| 2004/0118544 | A1 | 6/2004 | Tirimacco et al. | |
| 2004/0163785 | A1 * | 8/2004 | Shannon et al. | 162/158 |
| 2005/0034826 | A1 * | 2/2005 | Hu | 162/111 |
| 2005/0045293 | A1 | 3/2005 | Hermans et al. | |
| 2005/0252626 | A1 * | 11/2005 | Chen et al. | 162/125 |

FOREIGN PATENT DOCUMENTS

| | | | |
|---|---|---|---|
| GB | 2 304 123 | A | 3/1997 |
| WO | WO 2004/050374 | A1 | 6/2004 |

OTHER PUBLICATIONS

Andersson, Ingmar, "A Multi-Layering Headbox," Proceedings of the Second International Air Laid and Advanced Forming Conference, Nov. 16-18, 1980, Section X, pp. 1-20.
Ewald, James, "Forming Structured Products For Tissue, Towel & Other Paper Grades," Proceedings of the Second International Air Laid and Advanced Forming Conference, Nov. 16-18, 1980, Section XI, pp. 1-11.
TAPPI Official Test Method T 411 om-89, "Thickness (Caliper) of Paper, Paperboard, and Combined Board," published by the TAPPI Press, Atlanta, Georgia, revised 1989, pp. 1-3.
TAPPI Official Test Method T 570 pm-00, "Resistance to Mechanical Penetration of Sanitary Tissue Papers(ball burst procedure)," published by the TAPPI Press, Atlanta, Georgia, revised 2000, pp. 1-7.

* cited by examiner

*Primary Examiner*—José A Fortuna
(74) *Attorney, Agent, or Firm*—Gregory E. Croft

(57) ABSTRACT

Single-ply throughdried tissue sheets, particularly suitable as bath tissue, are produced with at least three layers. One or both of the outer layers suitably contain predominantly softwood fibers and a chemical bonding agent. One or more of the inner layers suitably contains a chemical debonder. The resulting tissues have a high level of durability and softness.

26 Claims, 5 Drawing Sheets

SOFT DURABLE TISSUE

BACKGROUND OF THE INVENTION

In the tissue business, product design has traditionally been an exercise in balancing softness against tensile strength. In order to induce a softness sensation when touched by the user, conventional tissue makers have tended to adopt a layered sheet structure having weakened outer layers. Chemical softening agents and/or different fiber types are often incorporated into the outer layers to further enhance the softness perception. Consequently, the mechanical integrity of the tissue is primarily provided by a relatively strong center layer. This practice produces a tissue with a superior surface feel that is often described as fuzzy, velvety, silky, flannelly and/or lotiony. Unfortunately, this practice also leads to a substantial increase in surface lint and slough. In addition, increasing the softness by this method negatively impacts the strength of the tissue. A weak tissue exhibiting surface lint and slough during use and/or which easily tears or which has low poke-through resistance will be perceived as less durable. To counter this perception, the traditional approach has been to increase the sheet tensile strength. Unfortunately, this practice increases the stiffness of the sheet by also increasing the bending resistance. A stiff tissue will be perceived as tough and harsh, which is particularly undesirable for a bath tissue.

In order to obtain a tissue having low stiffness with high strength, many tissue makers will produce a tissue product having two or three plies. In such multi-ply tissues, the amount of fiber on a per-ply basis is reduced as compared to that of a single-ply tissue having a similar or slightly lower basis weight. In general, a tissue sheet having a lower basis weight will bend more easily than a tissue with a higher basis weight with the same thickness, resulting in greater conformability in the user's hand. Consequently, a multi-ply tissue is generally seen as being-more conformable and having greater softness, while also being perceived as more durable.

Therefore there is a need for a softer, more durable single-ply tissue sheet especially useful for single-ply tissue products.

SUMMARY OF THE INVENTION

It has now been discovered that a highly-advantaged tissue sheet, such as would be particularly useful as a single-ply bath tissue product, for example, can be made by constructing the tissue sheet with three or more layers, wherein the two outer layers are relatively strong as compared to the inner layer. Suitably, the two outer layers comprise primarily long cellulosic fibers, such as softwood fibers, for durability, while the inner layer(s) is(are) highly debonded for flexibility. The tissue sheets of this invention are both durable and soft with adequate strength. Softness can be measured by the geometric mean stiffness factor (GMSF) (hereinafter defined), which takes into account the sheet strength. Durability can be measured by one or more of the geometric mean tensile energy (GMTE), the burst strength and/or the Slough/Lint Test value (all hereinafter defined). In a particular embodiment, an uncreped through-dried tissue basesheet is initially produced and thereafter subjected to a post treatment. The post treatment replaces some of the fiber-to-fiber hydrogen bonding in the outer layers of the sheet with covalent bonding. The hydrogen bonds are broken by an external mechanical force, such as creping, and the covalent bonds are created by the addition of a chemical bonding agent, such as certain latex binders.

Hence, in one aspect the invention resides in a layered tissue sheet having two outer fibrous layers and one or more inner fibrous layers, wherein at least one of said outer layers contains a chemical bonding agent and wherein both outer layers are relatively stronger than at least one of the inner layer or layers, said tissue sheet having a geometric mean tensile energy of about 60 grams (force)-centimeter or greater per centimeter and a geometric mean stiffness factor of about 6.0 or less.

In another aspect the invention resides in a layered tissue sheet having two outer layers consisting primarily of long cellulosic fibers and one or more inner layers of papermaking fibers, wherein at least one of said outer layers contains a chemical bonding agent and one or more inner layers contains a chemical debonding agent, said tissue sheet having a geometric mean tensile energy of about 60 grams (force)-centimeter or greater per centimeter and a geometric mean stiffness factor of about 6.0 or less.

In another aspect, the invention resides in a layered, single-ply, throughdried bath tissue sheet having two outer layers consisting primarily of softwood fibers and one or more inner layers of papermaking fibers, wherein at least one of said outer layers contains a chemical bonding agent and one or more inner layers contains a chemical debonding agent, said tissue sheet having a geometric mean tensile energy of about 60 grams (force)-centimeter or greater per centimeter and a geometric mean stiffness factor of about 6.0 or less.

In another aspect, the invention resides in a method of making a tissue sheet comprising the steps of (a) forming a layered tissue web having two outer layers and one or more inner layers, said outer layers containing primarily softwood fibers and the inner layer(s) containing primarily chemically debonded hardwood fibers; (b) throughdrying the layered web to form a layered tissue sheet; (c) applying a chemical bonding agent to one or both outer surfaces of the sheet; and (d) mechanically working the sheet to reduce the amount of fiber-to-fiber hydrogen bonding in one or both outer layers of sheet.

As used herein, a "layer" is a stratum within the tissue created by detectably different fiber compositions. Means for layering are well known in the art, the most typical being the use of a layered headbox to initially form the tissue. However, it is also possible to consolidate two wet fiber webs by couching them together to create a layered web. It is advantageous if one or both of the two outer layers are stronger than one or more of the inner layer(s). More specifically, the layer strength ratio (hereinafter defined) of one and/or both outer layers to that of at least one inner layer of the tissue sheet of this invention can be about 1.5 or greater, more specifically about 2.0 or greater, more specifically from about 1.5 to about 3.0, and still more specifically from about 2.0 to about 3.0.

The geometric mean tensile energy (GMTE) of the tissue sheets of this invention can be about 60 grams (force)-centimeters or greater per centimeter, more specifically about 80 grams (force)-centimeters or greater per centimeter, more specifically from about 80 to about 200 grams (force)-centimeters per centimeter, more specifically from about 90 to about 200 grams (force)-centimeters per centimeter and still more specifically from about 90 to about 190 grams (force)-centimeters per centimeter. (As used herein, "grams (force)" is sometimes abbreviated as "gf".)

The burst strength of the tissue sheets of this invention can be about 200 gf or greater, more specifically about 250 gf or greater, more specifically from about 200 to about 400 gf and still more specifically from about 300 to about 400 gf.

The Slough/Lint Test value of the tissue sheets of this invention can be about 6 milligrams (mg) or less, more specifically about 5 mg or less, still more specifically from about 1 to about 6 mg, and still more specifically from about 1 to about 5 mg.

The geometric mean stiffness factor (GMSF) of the tissue sheets of this invention can be about 6.0 or lower, more specifically from about 2.0 to about 6.0, more specifically from about 3.0 to about 6.0 and still more specifically from about 3.0 to about 5.0.

In addition, tissue sheets of this invention, particularly those to be used as single-ply bath tissue products, can optionally be further characterized by one or more of the following properties: bulk, cross-machine direction (CD) tensile strength, geometric mean tensile strength (GMT), CD stretch, CD wet strength, the CD wet strength/CD dry strength ratio (CD wet/dry), geometric mean surface roughness and basis weight (all hereinafter defined). All properties described herein are dry properties unless otherwise specified.

The bulk of the tissue sheets of this invention can be about 8 cubic centimeters or greater per gram, more specifically about 9 cubic centimeters or greater per gram, more specifically from about 8 to about 20 cubic centimeters per gram (cc/g), still more specifically from about 8 to about 15 cc/g, and still more specifically from about 9 to about 15 cc/g.

The cross-machine direction tensile strength of the tissue sheets of this invention can be about 100 gf or greater per centimeter of width (gf/cm), more specifically from about 100 to about 250 gf/cm and still more specifically from about 130 to about 200 gf/cm.

The geometric mean tensile strength of the tissue sheets of this invention can be about 220 gf or less per centimeter of width, more specifically from about 50 to about 220 gf/cm and still more specifically from about 150 to about 220 gf/cm.

The cross-machine direction stretch of the tissue sheets of this invention can be from about 10 to about 20 percent, more specifically from about 15 to about 20 percent.

The cross-machine direction wet tensile strength of the tissue sheets of this invention can be about 200 gf or less per 3 inches of width, more specifically from about 75 to about 200 gf per 3 inches of width, more specifically from about 75 to about 150 gf per 3 inches of width, more specifically from about 90 to about 130 gf per 3 inches of width. As will be noted below, CD wet strength is measured by a different tensile test method (Tensile Test Method "B") than some of the other tensile strength-related sheet properties.

The cross-machine direction wet strength/cross-machine direction dry strength ratio (CD wet/dry) of the tissue sheets of this invention can be about 0.2 or less, more specifically about 0.15 or less, more specifically from about 0.10 to about 0.20. For purposes of this sheet property measurement, both the dry and wet CD tensile strengths are measured using Tensile Test "B".

The geometric mean surface roughness (GMSR) of the tissue sheets of this invention can be about 8 microns or less, more specifically from about 2 to about 8 microns, more specifically from about 3 to about 7 microns. The sheet smoothness is enhanced by the presence of the bonding agent on the surface.

The basis weight of the bath tissue sheets of this invention (including the weight of binder present) can be from about 25 to about 50 grams per square meter (gsm), more specifically from about 30 to about 50 gsm, still more specifically from about 35 to about 50 gsm and still more specifically from about 40 to about 50 gsm.

Although the tissue sheets of this invention are particularly useful for single-ply products, they can also be used to make multiple-ply tissue products, such as two-ply or three-ply products, for example. For multi-ply products, applying a bonding agent to the surfaces of the ply or plies that are not either of the two exposed outer surfaces is not necessary. For single-ply products, treating both outer surfaces with a bonding agent is desirable.

Fibers useful for the two relatively strong outer layers of the tissue sheets of this invention are primarily long cellulosic fibers having a length-weighted average fiber length of about 1.8 millimeters or greater, more specifically about 2.0 millimeters or greater. Determining fiber length can be carried out by any suitable method known in the art. Long softwood papermaking fibers, such as northern softwood kraft fibers, are particularly useful. The amount of long fibers or long softwood fibers in the outer layer or layers, based on dry fiber, can be about 50 weight percent or greater, more specifically about 60 weight percent or greater, more specifically about 70 weight percent or greater, more specifically about 80 weight percent or greater, more specifically about 90 weight percent or greater and still more specifically about 95 weight percent or greater.

The bonding agent applied to one or both outer layers of the tissue sheet may play a role in delivering the properties of the tissue sheets of the present invention, although the nature of the particular bonding agent selected is not overly critical as long as the desired properties of the sheet are realized. For bath tissue sheets, however, the bonding agents will preferably have minimal or no ability to form covalent cross-linking bonds with themselves or with the cellulose fibers present after the bonding agent has been applied to the tissue sheet because any such covalent bonding may tend to reduce the dispersibility of the treated tissue sheet in water. It is believed that the bonding agent forms a polymeric film around fiber-to-fiber crossings when it dries. As a result, the fibers become mechanically trapped in this latex film and are held in place, thus increasing the tensile strength of the tissue sheet. When the sheet is wetted, however, the film softens and the fibers swell and pull out of the fiber/polymer film matrix. Consequently the bonding agent does not provide much, if any, additional wet strength to the sheet. Preferred bonding agents are also relatively soft or flexible. The softness or flexibility of the bonding agent can be determined from its glass transition temperature. The glass transition temperature of the preferred bonding agents is less than 50° C., more specifically less than 40° C., more specifically less than 20° C., more specifically from about −40° C. to about 40° C., and still more specifically from about −15° C. to about 20° C. Ideally, the glass transition temperature of the bonding agent is chosen such that it is low enough to provide the desired flexibility to the sheet, yet high enough to minimize tackiness at ambient temperature and humidity. While not limiting the scope of the invention, a particularly preferred class of chemical bonding agents useful for providing the bonding in one or both of the two outer layers of the tissue sheet is bonding agents derived from ethylene vinyl acetate copolymers and derivatives thereof. The ethylene vinyl acetate copolymers can be delivered in any form, including latex emulsions, as is well known in the art. It is believed that particular commercially available examples of such ethylene vinyl acetate latex binder materials include AIRFLEX® 426 (described in the literature as a carboxylated vinyl acetate-ethylene terpolymer) and AIRFLEX® 410, sold by Air Products Inc. Other suitable bonding agents can include, without limitation, polyvinyl chloride, styrene-butadiene, polyurethanes, as well as modified versions of the foregoing materials.

Suitable means for applying the chemical bonding agents include spraying and printing and are well known in the art. The deposition patterns grids, stripes, dots or other discrete shapes. A reticulated pattern or other continuous pattern may provide more strength to the web in comparison to patterns consisting of multiple discrete shapes. The bonding agent deposits can cover from about 30 percent to about 70 percent of the surface area of one both sides of the sheet, more specifically from about 40 to about 60 percent and still more specifically about 50 percent. The add-on amount of the bonding agent (on a solids basis) relative to the dry fiber weight of the sheet can be from about 0.5 to about 10 percent, more specifically from about 1.5 to about 6 percent and still more specifically from about 2 to about 4 percent.

Fibers useful for the one or more relatively weak inner layers of the tissues of this invention include any papermaking fibers, but particularly those fibers with relatively low hydrogen bonding capability, such as short cellulosic fibers having a length-weighted average fiber length of about 1.5 millimeters or less. Other suitable fibers include synthetic fibers, hardwood papermaking fibers, such as eucalyptus fibers, chemithermomechanical pulp (CTMP) fibers, bleached chemithermomechanical pulp (BCTMP), thermomechanical pulp (TMP) fibers, secondary fibers (recycled fibers), alpha pulp fibers, fibers which are chemically crosslinked so as to preclude hydrogen bonding, heat-treated fibers, and the like. Variations in the hydrogen bonding capability of the fibers can be accounted for by the optional addition of appropriate debonding agents in order to reduce the hydrogen bonding capability to a sufficiently low level.

Debonding agents useful for reducing the strength of one or more of the middle layers include any chemical that diminishes the capability of the fibers to hydrogen-bond together, thereby reducing the strength of the resulting sheet and increasing perceived softness. Such chemical debonders include, without limitation, quaternary ammonium compounds, mixtures of quaternary ammonium compounds with polyhydroxy compounds, and modified polysiloxanes. Examples of quaternary ammonium compounds suitable for use in the present invention include dialkyldimethylammonium salts such as ditallow dimethyl ammonium chloride, ditallow dimethylammonium methyl sulfate, and di(hydrogenated)tallow dimethyl ammonium chloride. Particularly suitable debonding agents are 1-methyl-2 noroleyl-3 oleyl amidoethyl imidazolinium methyl sulfate and 1-ethyl-2 noroleyl-3 oleyl amidoethyl imidazolinium ethylsulfate. Suitable commercial chemical debonding agents include, without limitation, Witco Varisoft® 6027 and Hercules Prosoft®) TQ 1003. The debonding agent(s) can be applied to the fibers of the inner layer(s) anywhere in the process, but are preferably applied to the fibers prior to forming the layer, although they could be applied to intermediate webs intended to be couched together with other webs to form the final sheet structure.

Various topical chemical additives can be applied to one or both outer surfaces of the tissue sheets of this invention, particularly when the tissue sheets are to be used for bath tissue products. Such additives particularly include, without limitation, softeners such as lotions, silicones and the like which are well known in the art.

Polysiloxanes may be especially preferred due to the ability to further reduce the surface roughness of the sheet. For bath tissue, hydrophilic polysiloxanes are especially preferred. One common class of hydrophilic polysiloxane is the so called polyether polysiloxanes. Such polysiloxanes generally have the following structure:

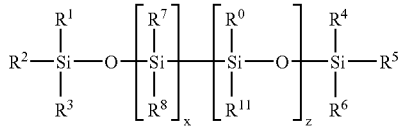

wherein "z" is an integer≧0 and "x" is an integer≧0. The ratio of "x" to "z" may be from to about 1000. The mole ratio of "x" to (x+z) may be from about 0 to about 0.95. The $R^0$-$R^9$ moieties may be independently any organo-functional group including a $C_1$ or higher alkyl or aryl group or mixtures of such groups. $R^{11}$ may be a polyether functional group having the generic formula: $—R^{12}—(R^{13}—O)_a—(R^{14}O)_b—R^{15}$, wherein $R^{12}$, $R^{13}$, and $R^{14}$ may be independently $C_{1-4}$alkyl groups, linear or branched; $R^{15}$ may be H or a $C_{1-30}$ alkyl group; and "a" and "b" are integers of from 0 to about 100 wherein "a+b" is greater than 0, more specifically from about 5 to about 30. An example of a commercially available polyether polysiloxane is DC-1248 available from Dow Corning.

A class of functionalized hydrophilic polysiloxanes particularly suitable for use in the present invention is polyether polysiloxanes that include an additional functional group capable of substantively affixing the hydrophilic polysiloxane to the pulp fibers. Such polysiloxanes may generally have the following structure:

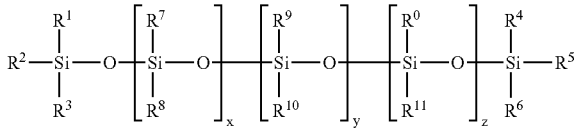

wherein "z" is an integer>0, "x" and "y" are integers≧0. The mole ratio of "x" to (x+y+z) may be from 0 to about 0.95. The ratio of "y" to (x+y+z) may be from 0 to about 0.40. The $R^0$—$R^9$ moieties may be independently any organofunctional group including $C_1$ or higher alkyl groups, aryl groups, ethers, polyethers, polyesters or other functional groups including the alkyl and alkenyl analogues of such groups. The $R^{10}$ moiety is a moiety capable of substantively affixing the polysiloxane to the cellulose. In a specific embodiment the $R^{10}$ moiety is an amino-functional moiety including, but not limited to, primary amine, secondary amine, tertiary amines, quaternary amines, unsubstituted amides, and mixtures thereof. An exemplary $R^{10}$ amino functional moiety may contain one amine group per constituent or two or more amine groups per substituent, separated by a linear or branched alkyl chain of $C_1$ or greater. $R^{11}$ may be a polyether functional group having the generic formula: $—R^{12}—(R^{13}—O)_a—(R^{14}O)_b—R^{15}$, wherein $R^{12}$, $R^{13}$, and $R^{14}$ may be independently $C_{1-4}$alkyl groups, linear or branched; $R^{15}$ may be H or a $C_{1-30}$alkyl group; and "a" and "b" are integers of from 1 to about 100, more specifically from about 5 to about 30. Examples of amino-functional polysiloxanes that may be useful in the present invention include the polysiloxanes provided under the trade designation of Wetsoft® CTW family manufactured and sold by Wacker, Inc., located Adrian, MI. In another aspect of the present invention, the moiety capable of affixing the polysiloxane substantively to the pulp fiber may be incorporated into the hydrophilic segment of the polysiloxane polymer or on one of the other $R^0$—$R^{11}$ moieties. In such case, the value of "y" in the foregoing structure for the hydrophilic polysiloxane may be 0.

Test Methods

Below are descriptions of various test methods used to determine some of the characteristics of the products of this invention. All samples are conditioned at 23±1° C. and 50±2% relative humidity for a minimum of 4 hours prior to testing and all tests are operated under the same ambient conditions.

Relative "layer strength" of uncreped tissue sheets can be determined using a tissue machine. Alternatively, for tissue sheets that are not uncreped or optionally for tissue sheets that are uncreped, the relative layer strength can be determined by making standard handsheets having the same composition as the various layers of the tissue sheet in question and then measuring the relative tensile strength of the handsheets. The relative layer strength data for Examples 3, 5 and 6 reported in Table 3 herein was generated using the tissue machine method. In either method, however, the relative layer strength for purposes herein reflects only the fibers and wet end chemicals present in the tissue sheet, such as the presence of a chemical debonding agent in the center layer, but does not include the presence of the chemical bonding agent(s) in the outer layer(s) that would make the outer layer(s) relatively even stronger.

In general, the tissue machine method involves measuring the geometric mean tensile strength of the tissue sheet in question with all of the layers present (the control). Then, by turning off the fiber supply (including any chemicals that may be provided in that layer, such as chemical debonding agents) to one or more of the headbox layering chambers while maintaining the same water flow, a tissue sheet is produced without the layer(s) being eliminated. The geometric mean tensile strength of the sheet with the missing layer(s) is then measured and the difference relative to the control is deemed to be the strength of the missing layer(s). By repeating this procedure while eliminating different layers, the relative strengths of all of the layers in a layered tissue sheet can be determined. By way of example, assume a three-layered tissue sheet having outer layer "A", inner layer "B" and outer layer "C" is made on a tissue machine having a three-layer headbox. By turning off the fiber/chemical supply to layer "B", a two-layer tissue sheet is produced having layers "A" and "C". By measuring the tensile strength of the resulting two-layer sheet, the difference in strength relative to the three-layer tissue sheet is the strength of layer "B". If layers "A" and "C" are the same, each layer is assumed to provide half of the resulting two-layer sheet strength. Hence the relative strengths of all three of the layers is determined. If layers "A" and "C" are not the same, then the procedure can be repeated, but this time turning off the fiber/chemical supply to layer "A" or "C". In this manner, the strength contribution of each layer can be determined. The handsheet method for determining relative layer strength simply involves making a standard handsheet having the same fiber and wet-end chemical composition as each of the various layers in the tissue sheet in question. The particular handsheet method is otherwise not critical. The basis weight of the handsheet should be 30 gsm in order to ensure that a sufficiently strong handsheet can be made for tensile testing. For handsheets, tensile testing in two directions is unnecessary since handsheets do not have a machine direction and cross-machine direction. Hence the tensile strength of a handsheet in any direction is considered to be an equivalent measure of the geometric mean tensile strength of the layer.

As used herein, the sheet "bulk" is calculated as the quotient of the caliper (hereinafter defined) of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

Tensile Test Method A

For purposes herein, this tensile test method is used to measure CD tensile strength, MD tensile strength, GMT, MD stretch, CD stretch, TE, GMTE, GMTS and GMSF. By this method, tensile strengths and related parameters are measured using a crosshead speed of 12.7 millimeters per minute, a jaw span (gauge length) of 76.2 millimeters and a specimen width of 25.4 millimeters. The MD tensile strength is the peak load per 10 millimeters of sample width when a sample is pulled to rupture in the machine direction. Similarly, the CD tensile strength represents the peak load per 10 millimeters of sample width when a sample is pulled to rupture in the cross-machine direction.

More particularly, samples for tensile strength testing are prepared by cutting a 1 inch (25.4 mm) wide by 4 inches (101.6 mm) long strip in either the machine direction (MD) or cross-machine direction (CD) orientation using a JDC Precision Sample Cutter (Thwing-Albert Instrument Company, Philadelphia, Pa., Model No. JDC3-10, Serial No. 37333). The instrument used for measuring tensile strength is an MTS Systems Sintech Serial No. 1G/071896/116. The data acquisition software is MTS TestWorks® for Windows Ver. 4.0 (MTS Systems Corp., Eden Prairie, Minn. 55344). The load cell is a 25 Newton maximum, such that the majority of peak load values fall between 10 and 90% of the load cell's full scale value. The gauge length between jaws is 3±0.04 inches (76.2±1 mm). The jaws are operated using pneumatic-action and are rubber coated. The minimum grip face width is 3 inches (76.2 mm), and the approximate height of a jaw is 0.5 inches (12.7 mm). The crosshead speed is 0.5±0.04 inches/min (12.7±1 mm/min), and the break sensitivity is set at 40%. The sample is placed in the jaws of the instrument, centered both vertically and horizontally. To adjust the initial slack, a pre-load of 1 gf at the rate of 0.1 inch per minute is applied for each test run. The test is then started and ends when the specimen breaks. The peak load is recorded as either the "MD tensile strength" or the "CD tensile strength" of the specimen depending on the sample being tested. At least 3 representative specimens are tested for each product, taken "as is", and the arithmetic average of all individual specimen tests is either the MD or CD tensile strength for the product.

As used herein, the "geometric mean tensile strength" is the square root of the product of the MD tensile strength multiplied by the CD tensile strength, both as determined above, expressed in grams (force) per centimeter.

In addition to tensile strength and stretch, "tensile energy" (TE) is calculated as the area under the load-extension curve during the same tensile test as described above. The area is based on the extension value reached when the sheet has reached the peak tensile load. That is, the sheet is strained to rupture, which defines the maximum tensile load. For the TE calculation, the load is converted to grams (force) per centimeter and the area under the curve is calculated by integration. The unit of extension is centimeters, so that the final TE units become grams (force)-centimeter/centimeter. The "geometric mean tensile energy" (GMTE) is the square root of the product of the machine direction TE and the cross-machine direction TE.

The "geometric mean tensile slope" (GMTS) is the square root of the product of the machine direction tensile slope and the cross-machine direction tensile slope. It is a measure of flexibility of the tissue. The tensile slope is the average slope of the load/elongation curve described above measured over the range of 0-20 grams (force). The slope is 20 grams (force)/centimeter divided by the strain value corresponding to a load of 20 grams (force)/centimeter when the width of the sample is 1 inch (2.54 cm).

The "geometric mean stiffness factor" (GMSF) is the ratio of the geometric mean tensile slope divided by the geometric mean tensile strength. The resultant ratio is dimensionless.

Tensile Test Method B

For purposes herein, this tensile strength test method is used to measure the CD wet tensile strength and the CD wet/dry ratio. (For purposes of determining the CD wet/dry ratio only, the CD dry tensile strength must also be measured using Tensile Test Method "B". By this method, tensile strengths are determined using a crosshead speed of 254 millimeters per minute, a full scale load of 4540 grams, a jaw span (gauge length) of 50.8 millimeters and a specimen width of 76.2 millimeters. The tensile strength is the peak load per 3 inches of sample width when a sample is pulled to rupture.

More particularly, samples for CD dry tensile strength testing are prepared by cutting a 3 inches (76.2 mm) wide×4 inches (10.2 mm) long strip in the CD orientation using a JDC Precision Sample Cutter (Thwing-Albert Instrument Company, Philadelphia, Pa., Model No. JDC3-10, Serial No. 37333). The instrument used for measuring tensile strengths is an MTS Systems Sintech 11S, Serial No. 6233. The data acquisition software is MTS TestWorks® for Windows Ver. 4.0 (MTS Systems Corp., Eden Prairie, Minn. 55344). The load cell is selected from either a 50 Newton or 100 Newton maximum, depending on the strength of the sample being tested, such that the majority of peak load values fall between 10 and 90% of the load cell's full scale value. The gauge length between jaws is 2±0.04 inches (50.8±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The sample is placed in the jaws of the instrument, centered both vertically and horizontally. The test is then started and ends when the specimen breaks. The peak load is recorded as the tensile strength of the specimen. At least six (6) representative specimens are tested for each product, taken "as is", and the arithmetic average of all individual specimen tests is CD dry tensile strength for the sheet.

The CD wet tensile strength is determined by the same procedure as described above, except the specimen is pre-wetted using the following steps.

1. Place the specimen on a blotter paper i.e. 54.4 kg/ream (120 lb/ream), reliance grade, cut into 24.13 cm×30 cm. The blotter paper is made by Curtis Fine Paper with the part number 13-01-14 or equivalent. A new blotter paper is used with each new specimen.
2. Place a pad (such as "Scotch-Brite" brand, general purpose scrubbing pad, made by 3M™ with the part number 96 or equivalent) into a pan that contains distilled water. Remove the excess water from the pad by tapping it lightly three times on the wetting pan screen.
3. Place the wet pad directly parallel to the 3 inches width of the specimen in the approximate center. Hold in place for approximately one second.
4. Place the pad back into the wetting pan.
5. Immediately insert the test specimen into the grips and the wet area should be approximately centered horizontally and vertically between the upper and lower grips.

The "cross-machine direction wet strength/cross-machine direction dry strength ratio" (CD wet/dry) for a tissue sheet sample is determined by dividing the wet CD tensile strength by the dry CD tensile strength, both as measured by Tensile Test Method "B", for a representative number of samples. The ratio is dimensionless.

The "burst strength" of a tissue sheet is determined by an EJA Burst Tester (series # 50360) made by Thwing-Albert Instrument Company in Philadelphia, Pa. The test procedure is according to TAPPI T570 pm-00 except the test speed. The test specimen is clamped between two concentric rings whose inner diameter defines the circular area under test. A penetration assembly the top of which is a smooth, spherical steel ball is arranged perpendicular to and centered under the rings holding the test specimen. The penetration assembly is raised at 6 inches per minute such that the steel ball contacts and eventually penetrates the test specimen to the point of specimen rupture. The maximum force applied by the penetration assembly at the instant of specimen rupture is reported as the burst strength in grams force (gf) of the specimen. Average value of six test specimens is reported. The penetration assembly consists of a spherical penetration member is a stainless steel ball with a diameter of 0.625±0.002 in (15.88±0.05 mm) finished spherical to 0.00004 in (0.001 mm). The spherical penetration member is permanently affixed to the end of a 0.375±0.010 in (9.525±0.254 mm) solid steel rod. A 2000 gram load cell is used and 50% of the load range i.e. 0-1000 g is selected. The distance of travel of the probe is such that the upper most surface of the spherical ball reaches a distance of 1.375 in (34.9 mm) above the plane of the sample clamped in the test.

A means to secure the test specimen for testing consisting of upper and lower concentric rings of approximately 0.25 in (6.4 mm) thick aluminum between which the sample is firmly held by pneumatic clamps operated under a filtered air source at 60 psi. The clamping rings are 3.50±0.01 in (88.9±0.3 mm) in internal diameter and approximately 6.5 in (165 mm) in outside diameter. The clamping surfaces of the clamping rings are coated with a commercial grade of neoprene approximately 0.0625 in (1.6 mm) thick having a Shore hardness of 70-85 (A scale). The neoprene needs not cover the entire surface of the clamping ring but is coincident with the inner diameter, thus having an inner diameter of 3.50±0.01 in (88.9±0.3 mm) and is 0.5 in (12.7 mm) wide, thus having an external diameter of 4.5±0.01 in (114±0.3 mm).

The "geometric mean surface roughness" (GMSR) is a measure of a surface property related to softness and is enhanced by the application of the binder to the surface of the tissue sheet. More specifically, the GMSR is the square root of the product of the machine direction surface roughness and the cross-machine direction surface roughness, expressed in microns. The surface roughness in both directions is represented as the surface mean deviation (SMD) using a Model KES-SE surface tester manufactured by Kato Tech Company, Japan. The probe for measuring SMD is a steel wire having a diameter of 0.5 mm. The probe is at the fixed position during the testing and is under a loading of 5 grams (force) (±0.5 gf). The tissue sample is placed on a moving plate that is moving at a constant velocity of 0.1 centimeter (cm) per second. The measured distance on the sample is 2 cm. The measurement sensitivity on the machine is set at "H" for standard conditions and a factor of 2 described in the operation manual is used to obtain the final readings. The SMD is the mean deviation of thickness of the sample along a 2-cm distance on the sample. Higher values of SMD indicate higher roughness and less smoothness.

The "Slough/Lint Test" value is a test that measures the resistance of tissue material to abrasive action when the material is subjected to a horizontally reciprocating surface abrader. More specifically, FIG. 5 is a schematic diagram of the test equipment that may be employed to abrade a sheet in accordance with the Slough/Lint Test. As shown, a machine 1 having a mandrel 3 receives a tissue sample 2. A sliding magnetic clamp 8 with guide pins (not shown) is positioned opposite a stationary magnetic clamp 9, also having guide pins 10 and 11. A cycle speed control 7 and start/stop controls 5 are provided. A counter 6 displays counts or cycles. The mandrel used for abrasion consists of a stainless steel rod, 0.5 inch in diameter, with the abrasive portion consisting of an 18-22 diamond particle micron coating (applied by SuperAbrasives, Inc., 28047 Grand Oaks Conn., Wixom, Mich. 48393) extending 4.25 inches in length around the entire circumference of the rod. The mandrel is mounted perpendicular to the face of the machine such that the abrasive portion of the mandrel extends out from the front face of the machine. On each side of the mandrel are located guide pins 10 and 11 that are used for interaction with the sliding magnetic clamp 8 and the stationary magnetic clamp 9, respectively. The sliding magnetic clamp and stationary magnetic clamp are spaced about 4 inches apart and centered about the mandrel. The sliding magnetic clamp and stationary magnetic clamp are configured to slide freely in the vertical direction.

Using a length of three sheets, sample specimens are cut using a paper cutter and precision cutter into 3 inches wide by 7 inches long samples. Each specimen needs to be cut in such a way that when it is mounted on the Slough/Lint tester, the mandrel does not abrade over the perforations. Only the tissue side facing the outside of the roll is tested. For tissue samples, the machine direction (MD) corresponds to the longer dimension. Each test strip is weighed to the nearest 0.1 mg. The sample 2 is placed against (not over) the guide pins and held in place with the sliding magnetic clamp 8. The specimen is draped over the mandrel and placed against the guide pins and the stationary magnetic clamp 9 is applied. Once the sample is in place, the sliding magnetic clamp is released to pull the sample taut and smooth.

The mandrel 3 is then moved back and forth in a path of an arc of a radius of 4.968 inches and a length of approximately 2.68 inches against the test strip for 40 cycles (each cycle consists of back and forth strokes) at a speed of about 80 cycles per minute, thereby removing loose fibers from the web surface. The sliding magnetic clamp and stationary magnetic clamp then are removed from the sample. All loose debris is removed by holding one corner of the specimen, using finger tips, and blowing both sides of the specimen with compressed air (approximately 5-10 psi). The sample is weighed to the nearest 0.1 mg and the weight loss calculated. Ten representative test samples per tissue sample are tested and the average weight loss value, in milligrams, is the Slough/Lint Test value for the sample. Between test runs, compressed air is used to blow off slough and lint debris from the mandrel and the test area.

Suitable papermaking processes useful for making tissue basesheets in accordance with this invention include throughdrying processes which are well known in the tissue and towel papermaking art, particularly including uncreped throughdrying processes. Such processes are described in U.S. Pat. No. 5,607,551 issued Mar. 4, 1997 to Farrington et al., U.S. Pat. No. 5,672,248 issued Sep. 30, 1997 to Wendt et al. and U.S. Pat. No. 5,593,545 issued Jan. 14, 1997 to Rugowski et al., all of which are hereby incorporated by reference.

In the interests of brevity and conciseness, any ranges of values set forth in this specification contemplate all values within the range and are to be construed as written description support for claims reciting any sub-ranges having endpoints which are whole number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5.

EXAMPLES

Example 1 (Uncreped Throughdried Basesheet)

Figure 1:
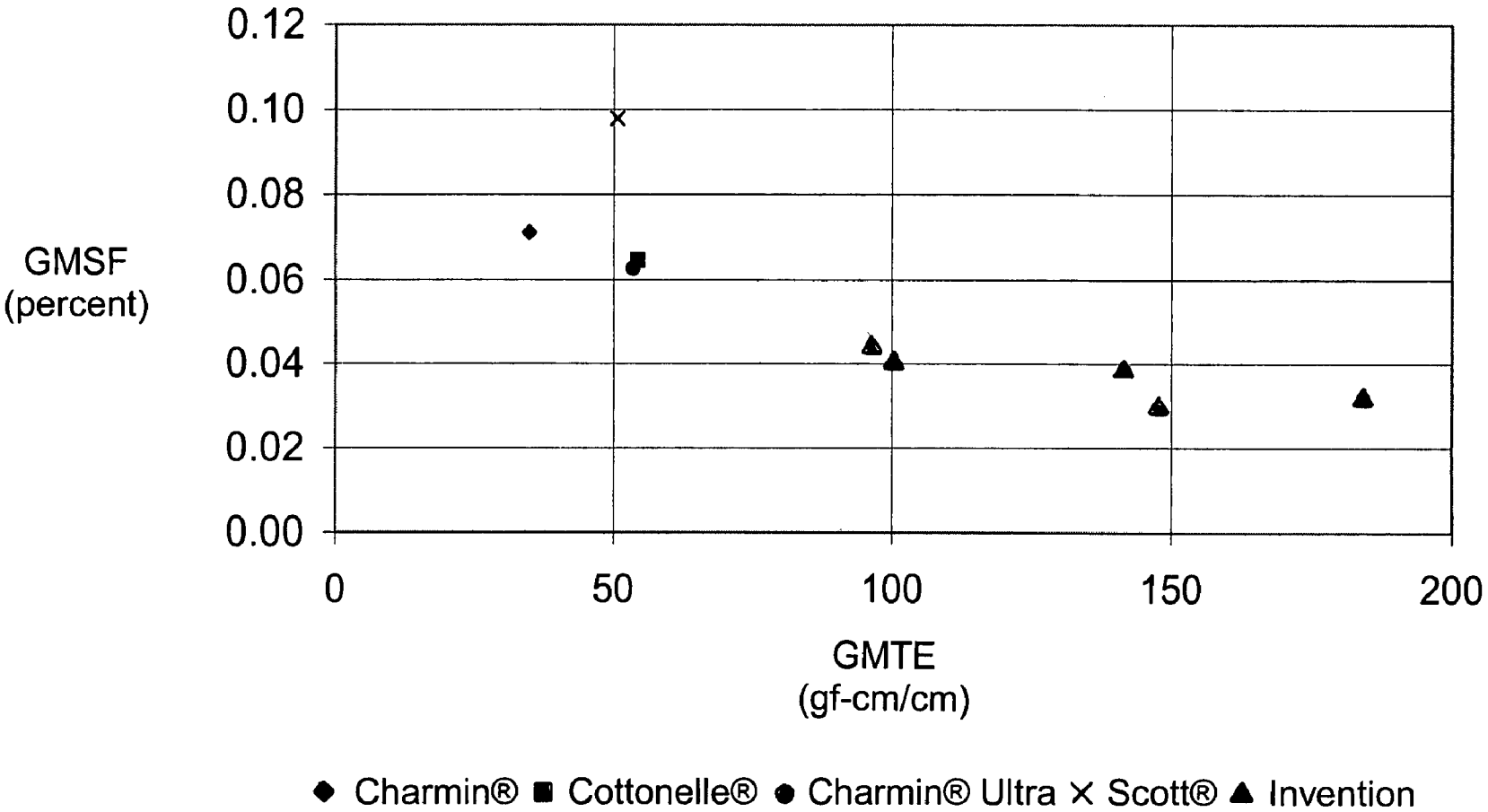
FIG. 1 is a plot of the geometric mean stiffness factor (GMSF) versus the geometric mean tensile energy (GMTE) for some commercially-available bath tissues and tissue sheets of this invention produced by Examples 2-6.
Figure 2:
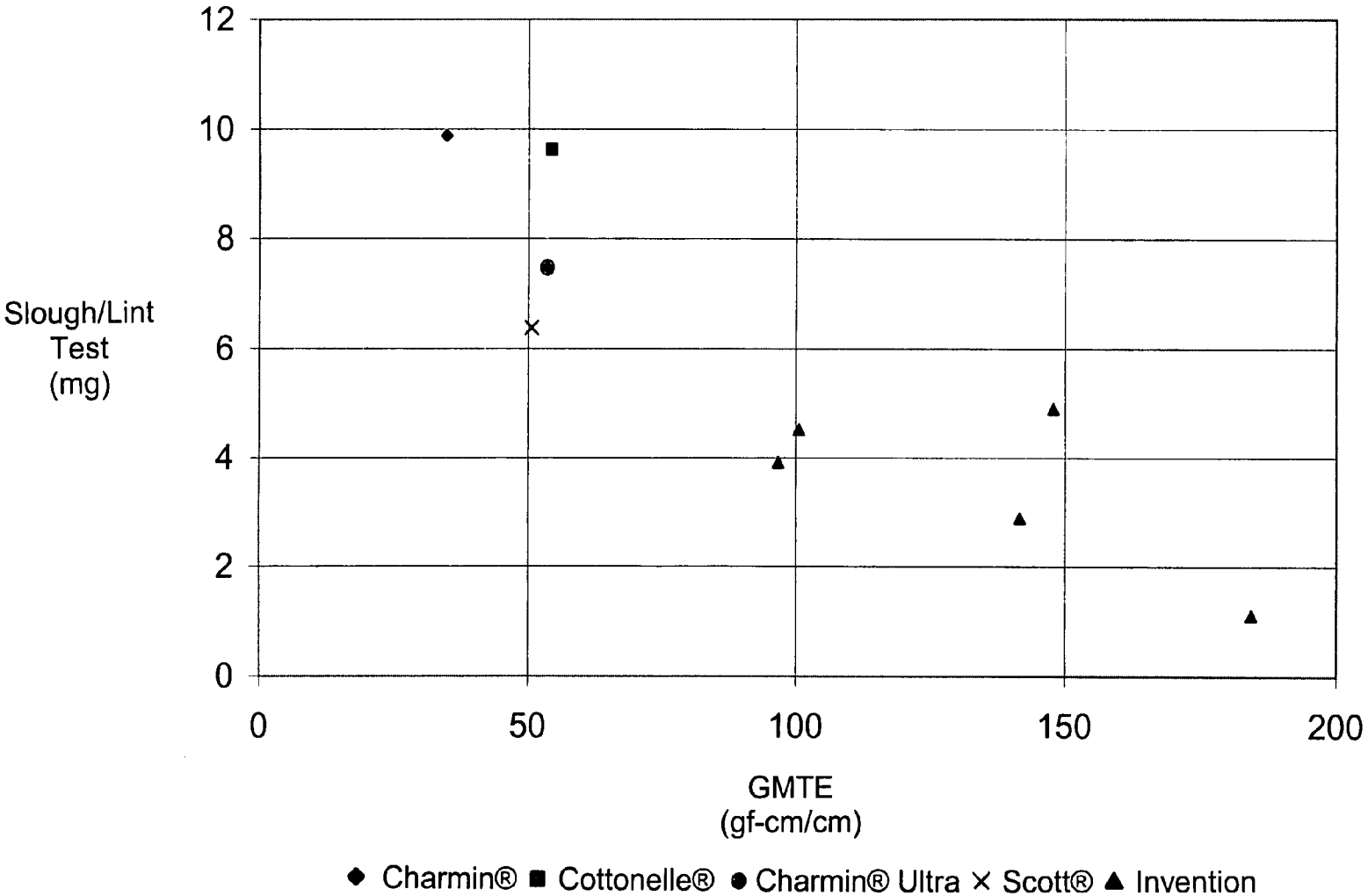
FIG. 2 is a plot of the Slough/Lint Test values versus the geometric mean tensile energy (GMTE) for the same samples plotted in FIG. 1.
Figure 3:
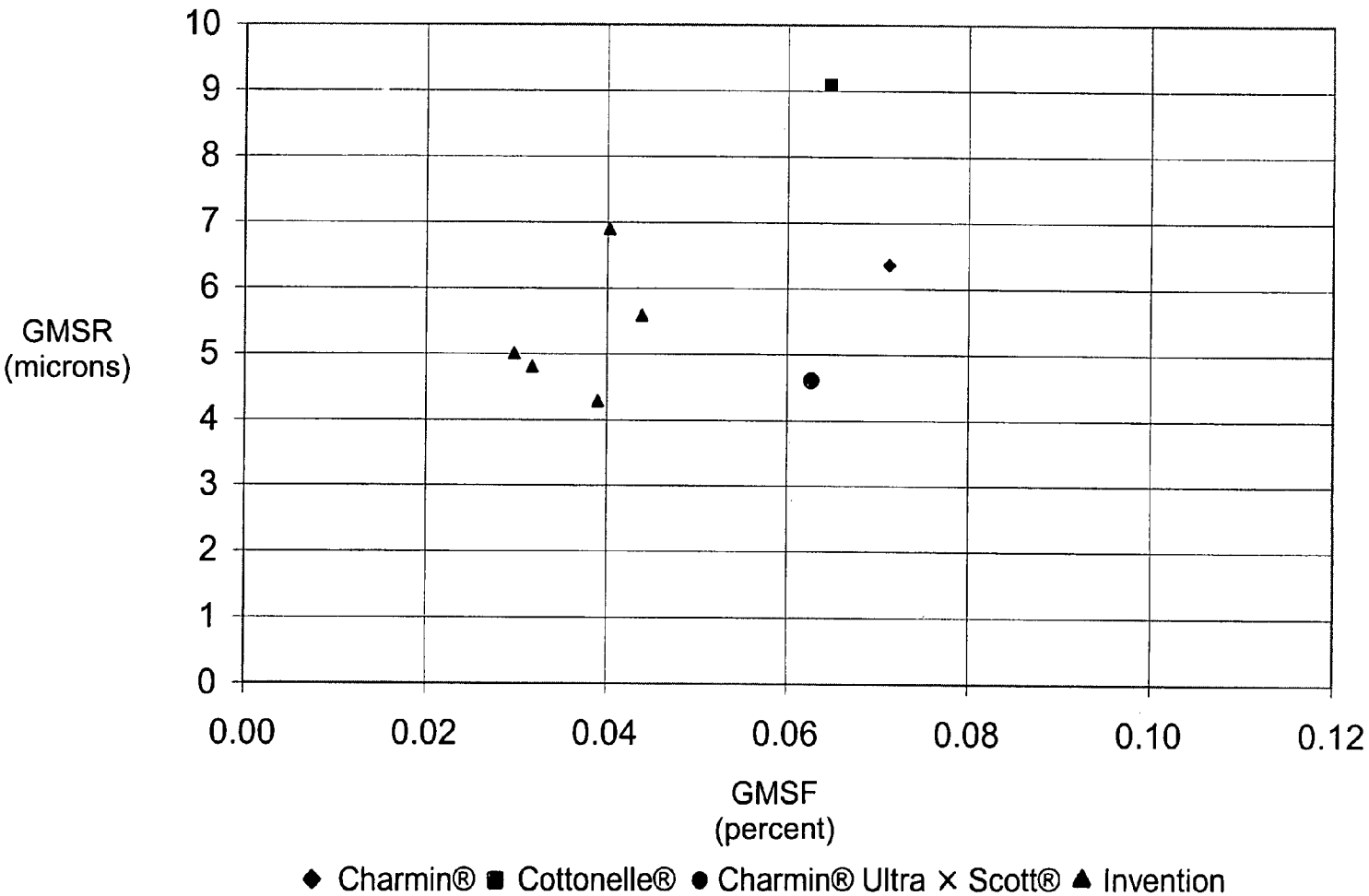
FIG. 3 is a plot of the geometric mean surface roughness (GMSR) versus the geometric mean stiffness factor (GMSF) for the same samples plotted In FIGS. 1 and 2.
Figure 4:
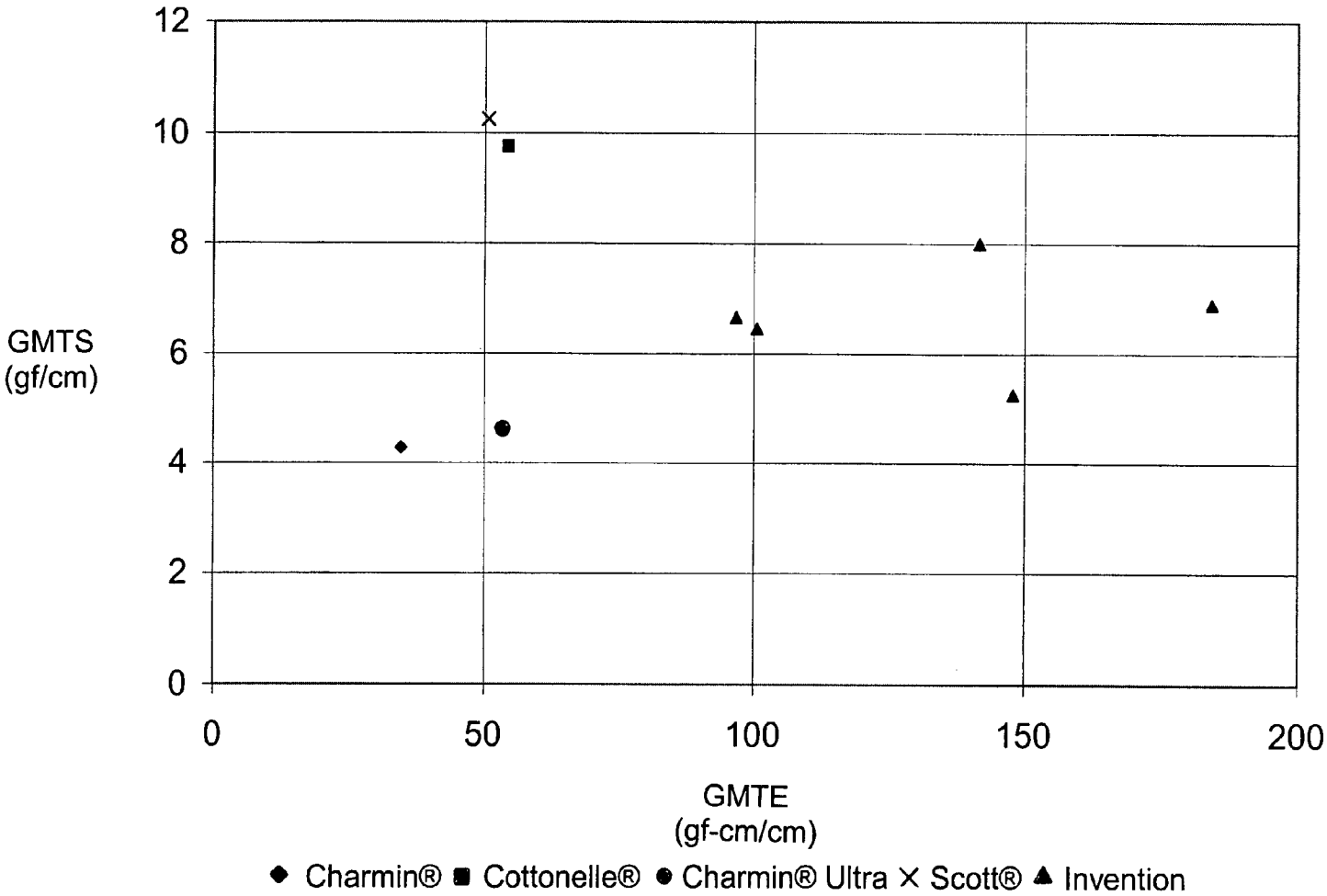
FIG. 4 is a plot of the geometric mean tensile slope (GMTS) versus the geometric mean tensile energy (GMTE) for the samples plotted in FIGS. 1-3.
Figure 5:
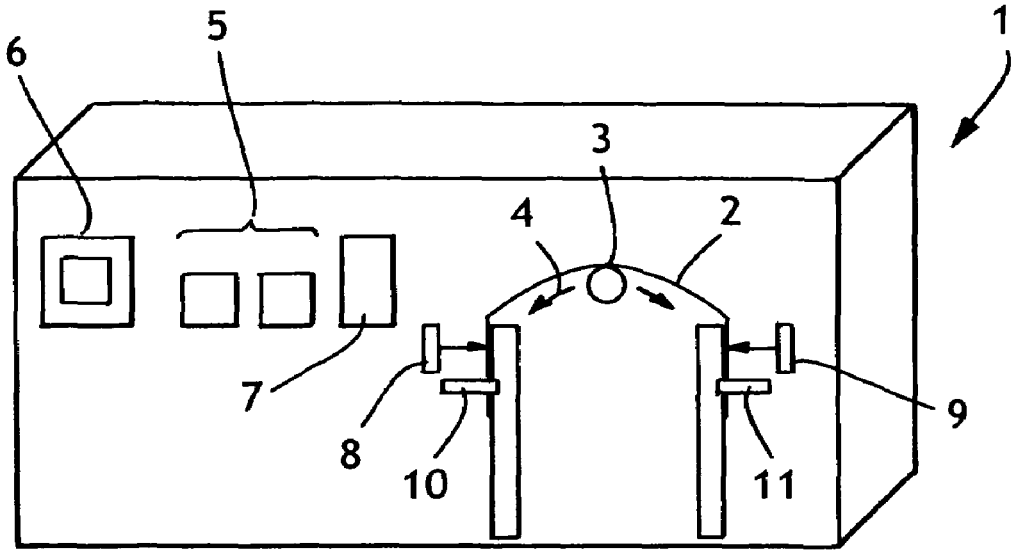
FIG. 5 is a schematic representation of the apparatus for conducting the Slough/Lint Test as described above.

In order to further illustrate this invention, a three-layered, single-ply, uncreped throughdried bath tissue basesheet in accordance with this invention was made in which the outer layers consisted of bleached northern softwood kraft fibers and the center layer consisted of debonded bleached northern hardwood kraft fibers.

Prior to formation, 100 pounds of bleached northern softwood kraft fiber (LL-19) was dispersed in a pulper for 30 minutes at a consistency of 3-5%. The stock was sent to a machine chest and diluted to a consistency of 1-2%. At the same time, 80 pounds of bleached hardwood (eucalyptus) kraft fiber was dispersed in a pulper for 20 minutes at a consistency of 2-3%. The stock slurry was sent to a machine chest and mixed with a cationic quaternary imidazoline debonder (Prosoft® TQ1003, commercially available from Hercules Inc., Wilmington, Del.) for 20-30 minutes. The debonder addition rate was 3.0 kg/mton of dry fiber.

A pilot tissue machine was used to produce a layered, uncreped throughdried bath tissue basesheet having a basis weight of 36 grams per square meter per ply. A three-layer headbox was used to form the wet web with only the northern softwood kraft stock in the two outer layers of the headbox and only the northern hardwood kraft stock in the center layer of the headbox. The overall basis weight split was 25/50/25 percent by weight. The headbox deposited the fibers on a forming fabric (Lindsay 2164-B33 by Voith Fabrics, Raleigh, N.C.) traveling at a speed of 55 feet per minute. The newly-formed three-layered web was then dewatered to a consistency of about 18-24 percent using vacuum suction from below the forming fabric before being rush-transferred to the transfer fabric (Lindsey T807-1 made by Voith Fabrics, Raleigh, N.C.). The transfer fabric was traveling at 50 feet per minute (about 9 percent rush transfer). A vacuum shoe pulling about 6-15 inches (150-380 millimeters) of mercury vacuum was used to transfer the web to the transfer fabric.

The web was then transferred to a throughdrying fabric (T1203-8 by Voith Fabrics, Raleigh, N.C.) at a consistency of 30-38 percent prior to the transfer. The throughdrying fabric was traveling at a speed of about 50 feet per minute. The web was carried over a Honeycomb throughdryer operating at a temperature of about 275° F. and dried to a final dryness of about 95-98 percent consistency. The resulting uncreped tissue basesheet was then wound into a parent roll by a reel.

Example 2

Invention

The uncreped throughdried tissue basesheet of Example 1 was treated with an aqueous latex binder composition (A426 from Air Products). The binder, having a consistency of 26.8 percent solids, was printed onto both sides of the basesheet via different patterned print rolls. Binder was applied to one side of the sheet with a print roll having a reticulated grid (repeating diamond) pattern. Each diamond was 0.090 inch in length (measured from center of line to center of line) and 0.060 inch in width. The line width for the pattern was 0.012 inch. The depth of the line was 23 microns (micrometers). The surface area coverage of this pattern was 41.5 percent. This pattern applies about 55 percent of the total latex binder applied to the sheet. Binder was applied to the other side of the sheet with a print roll having a print pattern consisting of discrete elements that are each comprised of three elongated hexagon-shaped printing cells. Each hexagon was about 0.02 inch long and had a width of about 0.006 inch. The hexagons within each discrete element were essentially in contact with each other and aligned in the machine direction. The spacing between discrete elements was approximately the width of one hexagon. Approximately 40 elements per inch were spaced in the machine direction and the cross-machine direction. The surface area of the sheet covered by the binder was about 45 percent. The solids add-on amount of the binder composition was 6.2 weight percent based on the dry fiber weight of the basesheet. The printed sheet was then passed through a pressing nip formed between a press roll and a metal creping drum in order to adhere the sheet to the drum. The creping drum was heated to an elevated temperature of 150° F. The sheet was then creped to partially debond the sheet and release it from the creping drum and thereafter rewound into a soft roll at the reel.

Example 3

Invention

A tissue sheet was made as described in Example 2, except the A426 binder solution contained 28 percent solids and the percent solids add-on was 4.6 percent.

Example 4

Invention

A tissue sheet was made as described in Example 2, except the A426 binder solution contained 21 percent solids and only one side of the sheet was printed with the binder. The creped side of the sheet was printed with the elongated hexagon pattern. The percent solids add-on was 2.8 percent by weight.

Example 5

Invention

A tissue sheet was made as described in Example 2, except the A426 binder solution contained 28 percent solids and the percent solids add-on was 6.4 percent.

Example 6

Invention

A tissue sheet was made as described in Example 2, except the A426 binder solution contained 22 percent solids and the percent solids add-on was 6.9 percent.

Example 7 (Commercially-Available Bath Tissues)

For comparison, four commercially-available bath tissues were obtained and tested as described above. Specifically, they were Charmin® and Charmin® Ultra toilet paper manufactured by Procter and Gamble, and Cottonelle®) and Scott®) bath tissue manufactured by Kimberly-Clark.

The physical property data for Examples 2-7 are summarized in Tables 1, 2 and 3 below.

TABLE 1

| Code | Basis Weight (gsm) | GMTE* (gf-cm/cm) | GMTS* (gf/cm) | GMSF* | GMSR (microns) | Slough/Lint Test (mg) |
|---|---|---|---|---|---|---|
| Charmin ® | 33.61 | 34.68 | 428.6 | 7.12 | 6.37 | 9.88 |
| Cottonelle ® | 31.30 | 23.41 | 550.0 | 7.98 | 9.09 | 9.26 |
| Charmin ® Ultra | 43.22 | 53.47 | 462.7 | 6.27 | 4.61 | 7.48 |
| Scott ® | — | 50.64 | 1024.7 | 9.78 | — | 6.38 |
| Example 2 | 40.73 | 184.43 | 690.2 | 3.17 | 4.81 | 1.11 |
| Example 3 | 39.81 | 96.69 | 665.5 | 4.39 | 5.6 | 3.92 |
| Example 4 | 40.91 | 100.57 | 645.4 | 4.02 | 6.9 | 4.52 |
| Example 5 | 44.03 | 147.89 | 525.6 | 2.97 | 5.01 | 4.9 |
| Example 6 | 48.74 | 141.67 | 800.0 | 3.90 | 4.29 | 2.88 |

| Code | GMT* (gf/cm) | CD Strength* (gf/cm) | CD Stretch* (%) | Burst Strength (gf) |
|---|---|---|---|---|
| Charmin ® | 60.20 | 47.58 | 10.40 | 129.1 |
| Cottonelle ® | 68.92 | 56.48 | 7.62 | 126.3 |
| Charmin ® Ultra | 73.80 | 60.92 | 13.61 | 169.2 |
| Scott ® | 104.78 | 59.04 | 6.02 | — |
| Example 2 | 217.85 | 199.98 | 15.94 | 373.1 |
| Example 3 | 151.63 | 136.51 | 11.99 | 312.39 |
| Example 4 | 160.42 | 147.18 | 11.80 | 317.36 |
| Example 5 | 176.89 | 169.63 | 14.68 | 331.14 |
| Example 6 | 204.96 | 132.19 | 19.82 | 328.84 |

*based on Tensile Test Method A

TABLE 2

| Code | Basis Weight (gsm) | CD Dry Tensile** (g/3") | CD Wet Tensile** (g/3") | CD Wet/Dry** |
|---|---|---|---|---|
| Charmin ® | 33.61 | 460.86 | 150.75 | 0.327 |
| Cottonelle ® | 31.30 | 501.76 | 151.82 | 0.303 |
| Charmin ® Ultra | 43.22 | 513.40 | 160.20 | 0.312 |
| Scott ® | — | | — | — |
| Example 2 | 40.73 | 931.30 | 131.32 | 0.141 |
| Example 3 | 39.81 | 644.55 | 92.66 | 0.144 |
| Example 4 | 40.91 | 636.61 | 88.38 | 0.139 |
| Example 5 | 44.03 | 838.08 | 119.33 | 0.142 |
| Example 6 | 48.74 | 683.13 | 118.27 | 0.173 |

**based on Tensile Test Method B

TABLE 3

| Code | Basis Weight (gsm) | Layer | Basis Weight (gsm) | Geometric Mean Tensile** (g/3") | Layer GMT Ratio** |
|---|---|---|---|---|---|
| Example 3 | 39.81 | LL19 | 21.59 | 328.4 | 3.0 |
| | | Eucalyptus | 21.59 | 107.0 | — |
| Example 5 | 44.03 | LL19 | 22.15 | 225.3 | 1.6 |
| | | Eucalyptus | 22.15 | 143.0 | — |
| Example 6 | 48.74 | LL19 | 24.37 | 251.6 | 2.2 |
| | | Eucalyptus | 24.37 | 113.0 | — |

**based on Tensile Test Method B

These results illustrate that the products of this invention have a substantially greater GMTE, a lower GMSF, higher burst strength, lower CD wet/dry and a substantially lower Slough/Lint Test value compared to the commercial products listed.

It will be appreciated that the foregoing description and examples, given for purposes of illustration, are not to be construed as limiting the scope of this invention, which is defined by the following claims and all equivalents thereto.

We claim:

1. A layered tissue sheet consisting of cellulose papermaking fibers, said sheet having two outer fibrous layers and one or more inner fibrous layers, wherein at least one of said outer layers contains a chemical bonding agent and wherein both outer layers are relatively stronger than at least one of the inner layer or layers, said tissue sheet having a geometric mean tensile energy from about 60 to about 200 grams (force)-centimeter and a geometric mean stiffness factor from about 2.0 to about 6.0 and having a cross-machine direction wet tensile strength of from about 75 to about 200 grams (force) per 3 inches.

2. A layered tissue sheet consisting of cellulose papermaking fibers, said sheet having two outer layers consisting primarily of softwood cellulosic fibers and one or more inner layers of papermaking fibers, wherein at least one of said outer layers contains a chemical bonding agent and one or more inner layers contains a chemical debonding agent and wherein both outer layers are relatively stronger than at least one of the inner layer or layers, said tissue sheet having a geometric mean tensile energy from about 60 to about 200 grams (force)-centimeter and a geometric mean stiffness factor from about 2.0 to about 6.0 and having a cross-machine direction wet tensile strength of from about 75 to about 200 grams (force) per 3 inches.

3. A layered, single-ply, throughdried bath tissue sheet consisting of cellulose papermaking fibers, said sheet having two outer layers consisting primarily of softwood fibers and one or more inner layers of papermaking fibers, wherein both of said outer layers contain a chemical bonding agent and one or more inner layers contains a chemical debonding agent and wherein both outer layers are relatively stronger than at least one of the inner layer or layers, said tissue sheet having a geometric mean tensile energy from about 60 to about 200 grams (force)-centimeter and a geometric mean stiffness factor from about 2.0 to about 6.0 and having a cross-machine direction wet tensile strength of from about 75 to about 200 grams (force) per 3 inches.

4. The tissue sheet of claim 1, 2 or 3 wherein the geometric mean stiffness factor is from about 3.0 to about 6.0.

5. The tissue sheet of claim 1, 2 or 3 wherein the geometric mean stiffness factor is from about 3.0 to about 5.0.

6. The tissue sheet of claim 1, 2 or 3 wherein the geometric mean tensile energy is from about 90 to about 200 grams (force)-centimeter per centimeter.

7. The tissue sheet of claim 1, 2 or 3 wherein the geometric mean tensile energy is from about 90 to about 190 grams (force)-centimeter per centimeter.

8. The tissue sheet of claim 1, 2 or 3 having a burst strength of from about 200 to about 400 grams (force).

9. The tissue sheet of claim 1, 2 or 3 having a burst strength of from about 300 to about 400 grams (force).

10. The tissue sheet of claim 1, 2 or 3 having a Slough/Lint Test value of from about 1 to about 6 milligrams.

11. The tissue sheet of claim 1, 2 or 3 having a Slough/Lint Test value of from about 1 to about 5 milligrams.

12. The tissue sheet of claims 1, 2 or 3 having a ratio of the geometric mean tensile strength of at least one outer layer to the geometric mean tensile strength of at least one inner layer of from about 1.5 to about 3.0.

13. The tissue sheet of claims 1, 2 or 3 having a ratio of the geometric mean tensile strength of at least one outer layer to the geometric mean strength of at least one inner layer of about 2.0 to about 3.0.

14. The tissue sheet of claims 1, 2 or 3 having a ratio of the geometric mean tensile strength of both outer layers to the geometric mean tensile strength of at least one inner layer of from about 2.0 to about 3.0.

15. The tissue sheet of claims 1, 2 or 3 having a cross-machine direction wet tensile strength of from about 75 to about 150 grams (force) per 3 inches.

16. The tissue sheet of claims 1, 2 or 3 having a cross-machine direction wet tensile strength of from about 90 to about 130 grams (force) per 3 inches.

17. The tissue sheet of claims 1, 2 or 3 having a CD wet/dry ratio of from about 0.1 to about 0.15 or less.

18. The tissue sheet of claims 1, 2 or 3 having a CD wet/dry ratio of from about 0.1 to about 0.2.

19. The tissue sheet of claims 1, 2 or 3 having a cross-machine direction stretch of from about 10 to about 20 percent.

20. The tissue sheet of claims 1, 2 or 3 having a cross-machine direction stretch of from about 15 to about 20 percent.

21. The tissue sheet of claim 1, 2 or 3 having a geometric mean surface roughness of from about 2 to about 8 microns.

22. The tissue sheet of claim 1, 2 or 3 having a geometric mean surface roughness of from about 3 to about 7 microns.

23. The tissue sheet of claim 1, 2 or 3 having a dry cross-machine direction tensile strength of from about 100 to about 250 grams (force) per centimeter.

24. The tissue sheet of claim 1, 2 or 3 having a dry cross-machine direction tensile strength of from about 130 to about 200 grams (force) per centimeter.

25. The tissue sheet of claims 1, 2 or 3 wherein both outer layers contain a bonding agent.

26. The tissue sheet of claims 1, 2 or 3 having a topically-applied softening agent.

* * * * *